US007896200B2

(12) United States Patent
Nakatsuji et al.

(10) Patent No.: US 7,896,200 B2
(45) Date of Patent: Mar. 1, 2011

(54) LIQUID SUBSTANCE SUPPLYING DEVICE

(75) Inventors: Hachiro Nakatsuji, Osaka (JP); Akira Iizuka, Saga (JP); Akira Kabeshita, Osaka (JP)

(73) Assignee: Panasonic Corporation, Osaka (JP)

( * ) Notice: Subject to any disclaimer, the term of this patent is extended or adjusted under 35 U.S.C. 154(b) by 530 days.

(21) Appl. No.: 11/573,043

(22) PCT Filed: Jun. 8, 2006

(86) PCT No.: PCT/JP2006/311967

§ 371 (c)(1),
(2), (4) Date: Feb. 1, 2007

(87) PCT Pub. No.: WO2006/132428

PCT Pub. Date: Dec. 14, 2006

(65) Prior Publication Data

US 2009/0008398 A1 Jan. 8, 2009

(30) Foreign Application Priority Data

Jun. 10, 2005 (JP) ..... 2005-170649
Jun. 10, 2005 (JP) ..... 2005-170650

(51) Int. Cl.
*B05B 15/06* (2006.01)

(52) U.S. Cl. ..... 222/165; 222/131; 222/327; 222/389; 220/318

(58) Field of Classification Search ..... 222/131, 222/144, 160, 164–167, 325–327, 386, 387, 222/389; 220/318, 737
See application file for complete search history.

(56) References Cited

U.S. PATENT DOCUMENTS 2,423,969 A * 7/1947 Foltz ..... 366/224

(Continued)

FOREIGN PATENT DOCUMENTS

EP 0 140 136 A1 9/1984

(Continued)

OTHER PUBLICATIONS

Japanese Office Action.

(Continued)

*Primary Examiner*—J. Casimer Jacyna
(74) *Attorney, Agent, or Firm*—Pearne & Gordon LLP

(57) ABSTRACT

It is an object of the invention to provide a liquid substance supplying device exhibiting high operability in handling a container having a large capacity. A liquid substance supplying device for supplying a liquid substance reserved in a vertically elongated container 30 has a configuration in which a bottom part of a container holder 15 for holding the container inserted through an insertion hole provided on a top side of a holder main body 16 is pivoted on a base bracket 14 with a hinge portion 19 to support the container holder 15 such that it can assume either upright attitude or tilted attitude and in which the container holder 15 is fixed in the upright attitude by a holder fixing mechanism 20. As a result, the container holder 15 can be mounted and removed to and from the holder main body 16 in the tilted state at the time of a container replacing operation, which allows high operability to be maintained even in handling a large-capacity container having a great height dimension.

7 Claims, 16 Drawing Sheets

U.S. PATENT DOCUMENTS

| | | | | |
|---|---|---|---|---|
| 4,210,263 | A | 7/1980 | Bos | |
| 5,102,010 | A * | 4/1992 | Osgar et al. | 222/1 |
| 2004/0232168 | A1 | 11/2004 | Ciavarella et al. | |

FOREIGN PATENT DOCUMENTS

| | | | |
|---|---|---|---|
| EP | 0 408 583 | B1 | 11/1995 |
| EP | 1 514 613 | A1 | 3/2005 |
| JP | 03-502677 | A | 6/1991 |
| JP | 4-23657 | U | 2/1992 |
| JP | 2591744 | | 1/1999 |
| JP | 11-244758 | | 9/1999 |
| JP | 2000-288452 | A | 10/2000 |
| JP | 2001-287798 | A | 10/2001 |
| JP | 2003-192100 | A | 7/2003 |
| JP | 2004-232480 | A | 8/2004 |

OTHER PUBLICATIONS

Japanese Office Action dated Aug. 18, 2009 for Japanese Patent Application No. JP-2005-170650.

Japanese Office Action dated Aug. 18, 2009 for Japanese Patent Application No. JP-2005-170649.

* cited by examiner

LIQUID SUBSTANCE SUPPLYING DEVICE

TECHNICAL FIELD

The present invention relates to a liquid substance supplying device for reserving a liquid substance such as a resin adhesive in a container and supplying the substance from the container.

BACKGROUND ART

In the field of electronic component mounting, resin adhesives are widely used for purposes such as securing an electronic component on a substrate. Liquid substances such as resin adhesives are treated by reserving them in containers such as syringes and cartridges. When those liquid substances are supplied to an application apparatus for applying them to a workpiece such as a substrate, the containers in which the liquid substances are reserved are mounted in container holders provided on a discharging apparatus, application apparatus or the like (see Patent Documents 1 and 2, for example). The liquid substances reserved in those containers are pneumatically discharged from the containers. When a liquid substance in a container is fully consumed, the used container is removed from the container holder to be replaced by a new container.

| | |
|---|---|
| [Patent Document 1] | JP-A-11-244758 |
| [Patent Document 2] | Japanese Utility Model Registration No. 2,591,744 |

DISCLOSURE OF THE INVENTION

Recently, there is demand for the maximization of the availability factor of production facilities used in the field of electronic component mounting for the purpose of improving production efficiency. As a result, there is a tendency to use containers having larger capacities in apparatus in which liquid substances must be supplied for purposes such as the application of a resin adhesive, so that the frequency of container replacement as described above can be reduced. When such containers having large capacities are used, the increase in the size of containers necessitates a greater handling space for container replacing operations and the like in an apparatus when compared to the related art and also results in an increase in a pneumatic force required for discharging liquid substances. For this reason, it is desirable to pay more attention to sealing performance and operability of mounting and replacing operations than in apparatus according to the related art.

However, apparatus according to the related art including the examples in the above-cited Patent Documents have been configured on the assumption that conventional syringes or cartridges of standard sizes are primarily used. For this reason, those apparatus according to the related art do not have a structure suitable for the use of containers having large capacities which have recently come into use. Therefore, there have been demands for a liquid substance supplying device which accommodates containers having large capacities and which has high sealing performance and operability.

Under the circumstance, it is an object of the invention to provide a liquid substance supplying device which accommodates containers having large capacities and which has high sealing performance and operability.

A liquid substance supplying device according to the invention is a liquid substance supplying device for supplying a liquid substance reserved in a vertically elongated container, comprising a container holder for holding said container inserted through an insertion hole provided on a top side thereof a holder supporting mechanism for supporting said container holder in either upright attitude or tilted attitude, and a holder fixing mechanism for fixing the attitude of said container holder in the upright state thereof.

A liquid substance supplying device according to the invention is a liquid substance supplying device for supplying a liquid substance reserved in a substantially cylindrical container having an opening at a top end thereof, comprising a container holder for holding said container inserted from a top side thereof with a flange portion formed on said top end supported from underneath by a top surface of a holder main body, a holder supporting mechanism for supporting said container holder in either upright attitude or tilted attitude, a holder fixing mechanism for fixing the attitude of said container holder in the upright state, a lid having a first sealing portion which is inserted in the opening of said container held by said container holder to seal the interior of said container and a second sealing portion which abuts on a top surface of said flange portion supported from underneath by said holder main body and is urged by the surface to seal said opening, a lever which is pivoted by a first fulcrum secured to said container holder at a top end thereof to be rotatable in the vertical direction, and a link member which is pivoted by a second fulcrum provided in a position of said lever apart from said first fulcrum at one end thereof to be rotatable in the vertical direction and which has an engaging portion engaging a portion to be engaged provided on said lid at another end thereof. The device is configured such that said lever is rotated downward with said engaging portion engaged with said portion to be engaged to insert said first sealing portion into said opening and to urge said second sealing portion against the top surface of said flange portion.

According to the invention, a lid opening/closing mechanism is provided to elevate the link member having the engaging portion engaging the portion to be engaged provided on the lid for sealing a container by rotating the lever. Thus, a configuration is provided, in which the interior of the container is sealed by rotating the lever downward to pull down the engaged portion with the engaging portion and in which the lid is opened by rotating the lever upward to push the engaged portion upward with the engaging portion. Thus, a liquid substance supplying device can be provided, which accommodates containers having large capacities and which has high sealing performance and operability.

DESCRIPTION OF REFERENCE NUMERALS

Figure 1:
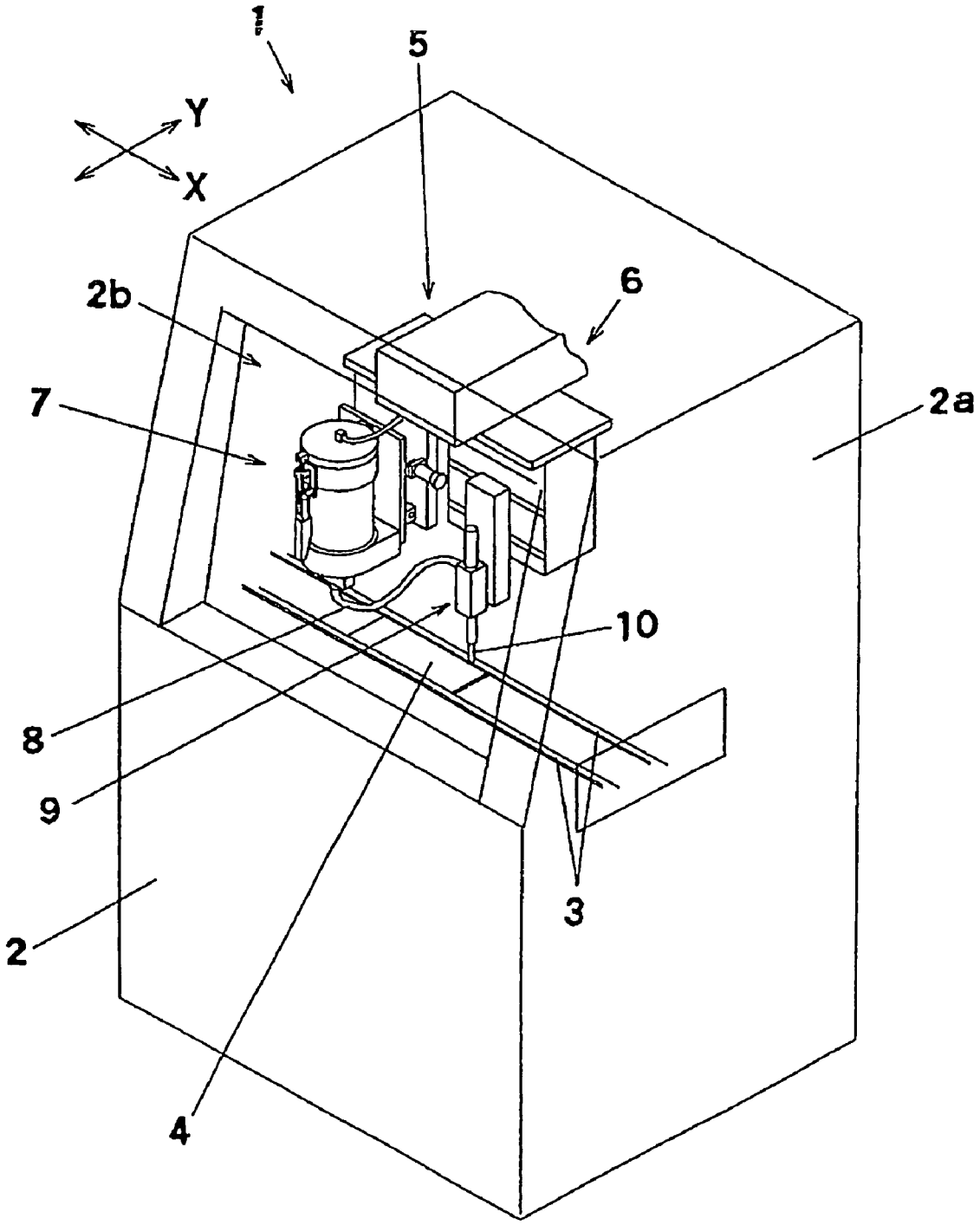
FIG. 1 is a perspective view of an application apparatus in an embodiment of the invention.

1: application apparatus
5: application mechanism
6: application head moving mechanism
7: tank head
9: application head
11: Y-axis table
12: Y-direction moving member
15: container holder
16: holder main body
17: lid opening/closing mechanism
18: lid
19: hinge portion
20: holder fixing mechanism
25: link rod
26: portion to be engaged
27: lever
30: container
30*b*: flange portion
31: resin adhesive
48: engaging hook

BEST MODE FOR CARRYING OUT THE INVENTION

An embodiment of the invention will now be described with reference to drawings.

First, a general structure of an application apparatus 1 will be described with reference to FIG. 1. Referring to FIG. 1, the application apparatus 1 has a configuration in which a substrate conveying mechanism 3 and a liquid substance application mechanism 5 are disposed on a base 2. The substrate conveying mechanism 3 conveys and positions a substrate 4 to which a resin adhesive that is a liquid substance is to be applied. The application mechanism 5 has a configuration in which an application head 9 having an application nozzle 10 for ejecting the resin adhesive is moved by an application head moving mechanism 6.

The application mechanism 5 is provided with a tank head 7 having a container 30 (see FIGS. 3 and 6) for reserving the resin adhesive, and the resin adhesive is supplied from the tank head 7 to the application head 9 through a tube 8. A cover opening 2*b* is provided on a front side of a cover frame 2*a* provided so as to surround the application mechanism 5, and operations such as maintenance and checking of the application head 9 and replacement of a container can be conducted through the cover opening 2*b*.

Figure 2:
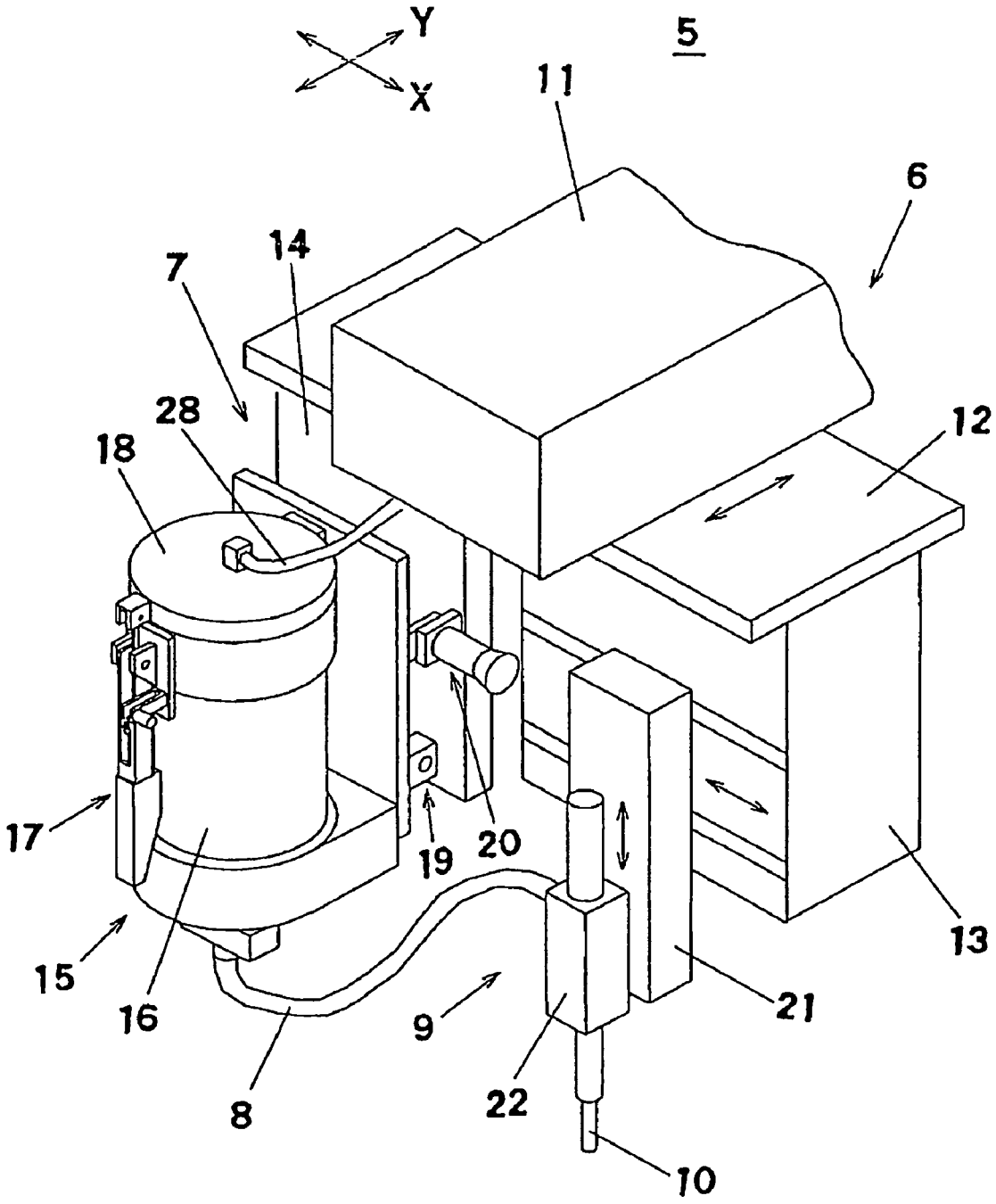
FIG. 2 is a perspective view of a liquid substance application mechanism of the application apparatus in the embodiment of the invention.

As shown in FIG. 2, the application head moving mechanism 6 is configured by mounting an X-axis table 13 and a base bracket 14 in the form of a vertical plate on a Y-axis moving member 12 attached to a bottom surface of a Y-axis table 11 and attaching an elevation table 21 to the X-axis table 13. An ejection mechanism 22 forming a part of the application head 9 is attached to the elevation table 21, and the ejection mechanism 22 is moved along with the application nozzle 10 in each of a direction, Y-direction, X-direction, and Z-direction by driving the Y-axis table 11, X-axis table 13, and the elevation table 21.

The tank head is disposed on the base bracket 14, and the tank head 7 is moved in the Y-direction by driving the Y-axis table 12 to move the Y-direction moving member 12. The tank head 7 has a container holder 15, and the container holder 15 is constituted by a holder main body 16, a lid 18, and a lid opening/closing mechanism 17.

The container holder 15 is pivotally supported by a hinge portion 19 provided at a lower part of the base bracket 14, and a holder fixing mechanism 20 for fixing the container holder 15 is provided at the base bracket 14 above the hinge portion 19. The container holder 15 can be tilted from a vertical attitude about the hinge portion 19 serving as a fulcrum by removing the fixation of the container holder 15 with the holder fixing mechanism 20.

Figure 3:
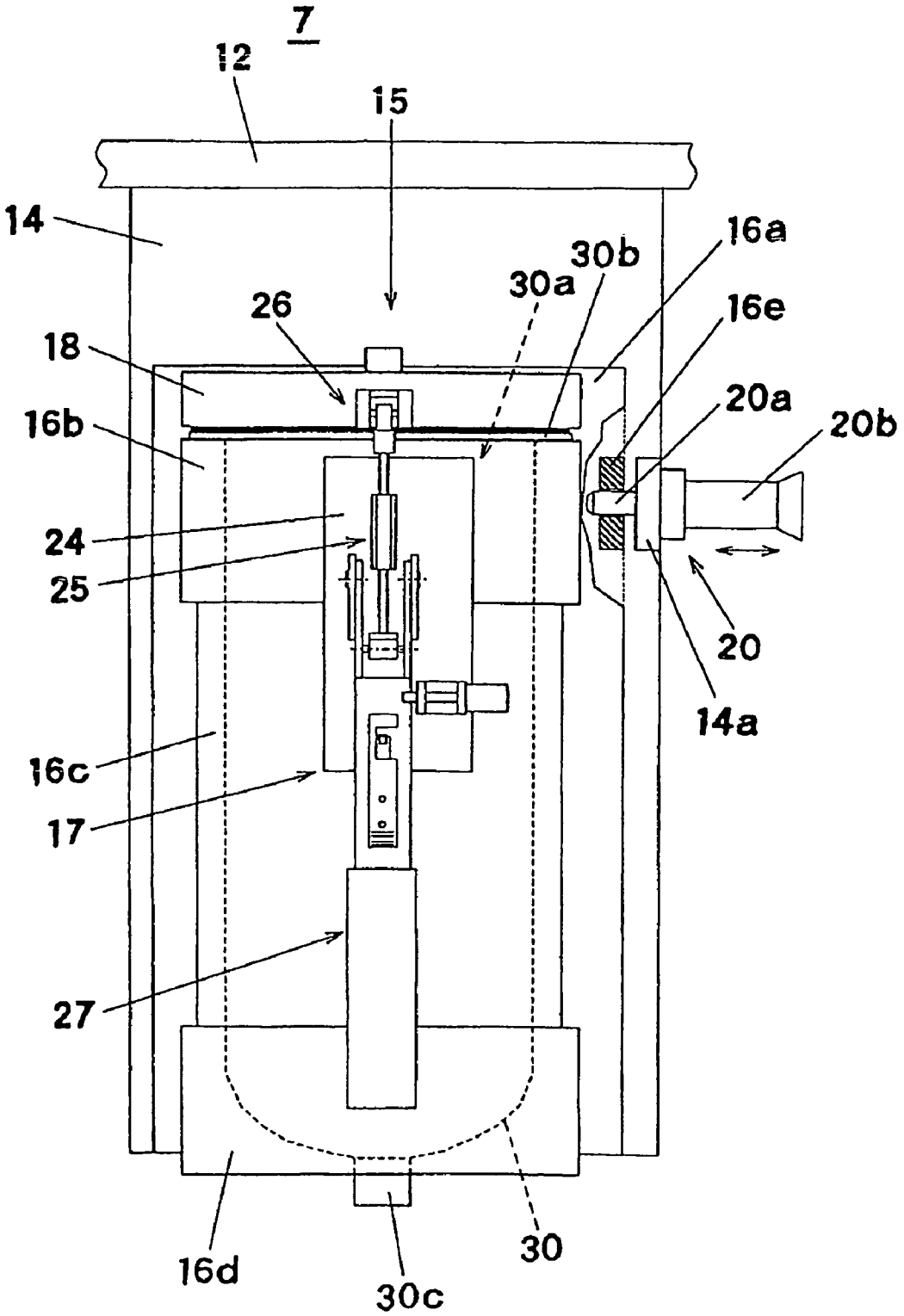
FIG. 3 is a front view of a tank head of the application apparatus in the embodiment of the invention.
Figure 4:
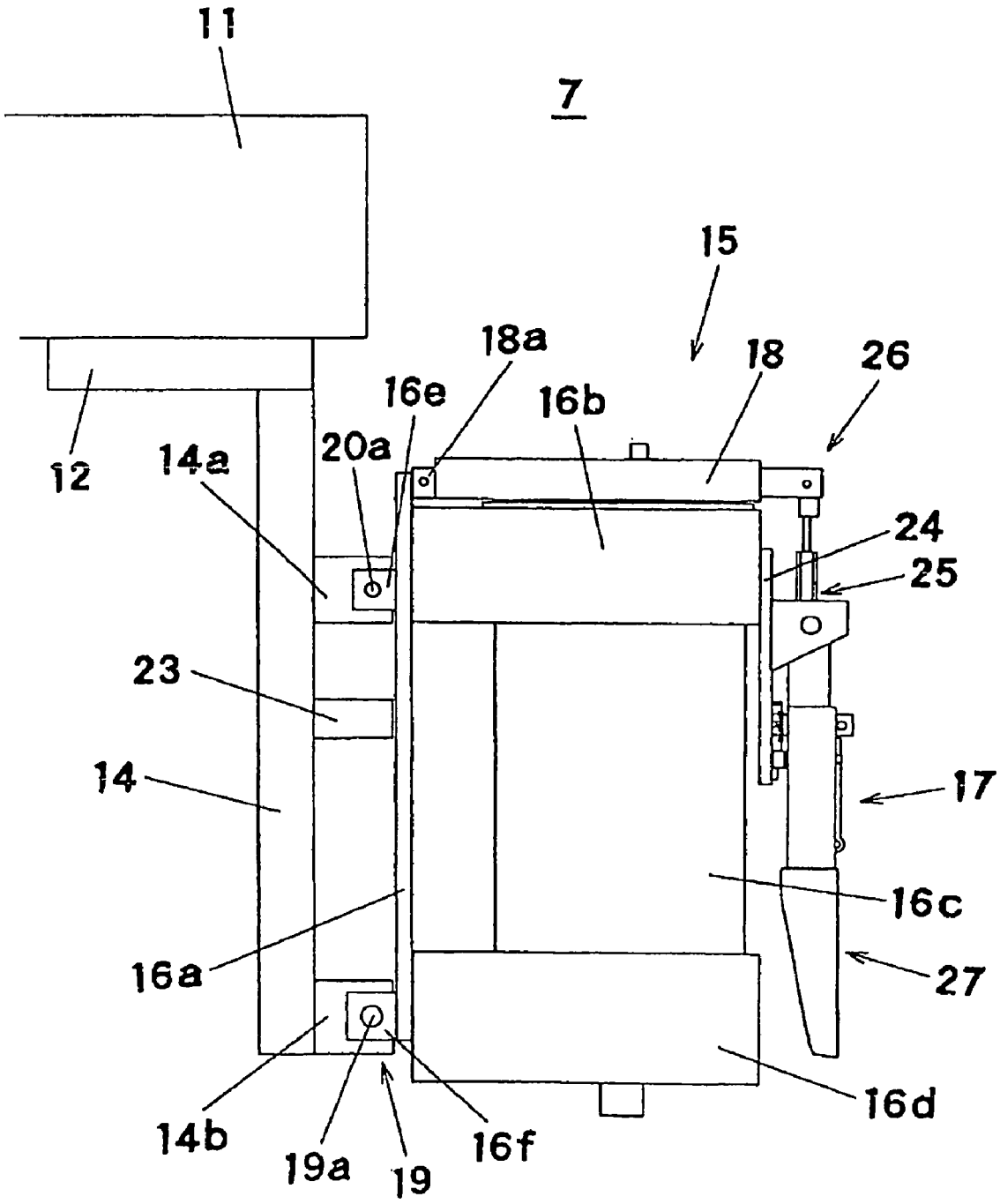
FIG. 4 is a side view of the tank head of the application apparatus in the embodiment of the invention.

A structure of the container holder 15 will now be described with reference to FIGS. 3 and 4. Referring to FIGS. 3 and 4, the container holder 15 holding a container 30 is attached to a front side (right side in FIG. 4) of the base bracket 14 secured to the bottom surface of the Y-direction moving member 12. The container 30 is a substantially cylindrical and vertically elongated syringe having an opening 30*a* on a top end thereof, and a liquid substance such as a resin adhesive is reserved in the same (see FIG. 6 too).

The container holder 15 comprises a holder main body 16 which is primarily constituted by a vertical back plate 16*a* and a top part 16*a*, a cylindrical part 16*c*, and a bottom part 16*d* arranged in the vertical direction in connection with each other, a lid 18 which closes the holder main body 16 from above, and a lid opening/closing mechanism which opens and closes the lid 18. An insertion hole is provided at the top part 16*b* to allow the container 30 to be inserted from the top side. The cylindrical part 16*c* and the bottom part 16*d* hold a middle part and a bottom part of the container 30 inserted, respectively.

As shown in FIG. 4, the hinge portion 19 has a configuration in which a pivot plate 16*f* provided to protrude from a back side (left side in FIG. 4) of a bottom end of the back plate 16*a* is pivoted by a pivot bracket 14*b* provided on a front side of a bottom end of the base bracket 14 through a pin 19*a*. As shown in FIG. 3, a locking plate 16*e* having a pin hole provided thereon is provided on a back side of an upper part of the back plate 16*a* so as to extend to the left.

A locking bracket 14*a* for supporting a pin 20*a* such that the pin can slide in the horizontal direction is provided on a front side of an upper part of the base bracket 14 in association with the position of the locking plate 16*a*. The pin 20*a* is coupled with a grip 20*b*, and the pin 20*a* can be fitted and removed in and from the pin hole of the locking plate 16*e* by gripping and operating the grip 20*b*. The locking bracket 14*a*, the pin 20*a*, and the grip 20*b* constitute the holder fixing mechanism 20.

Figure 5:
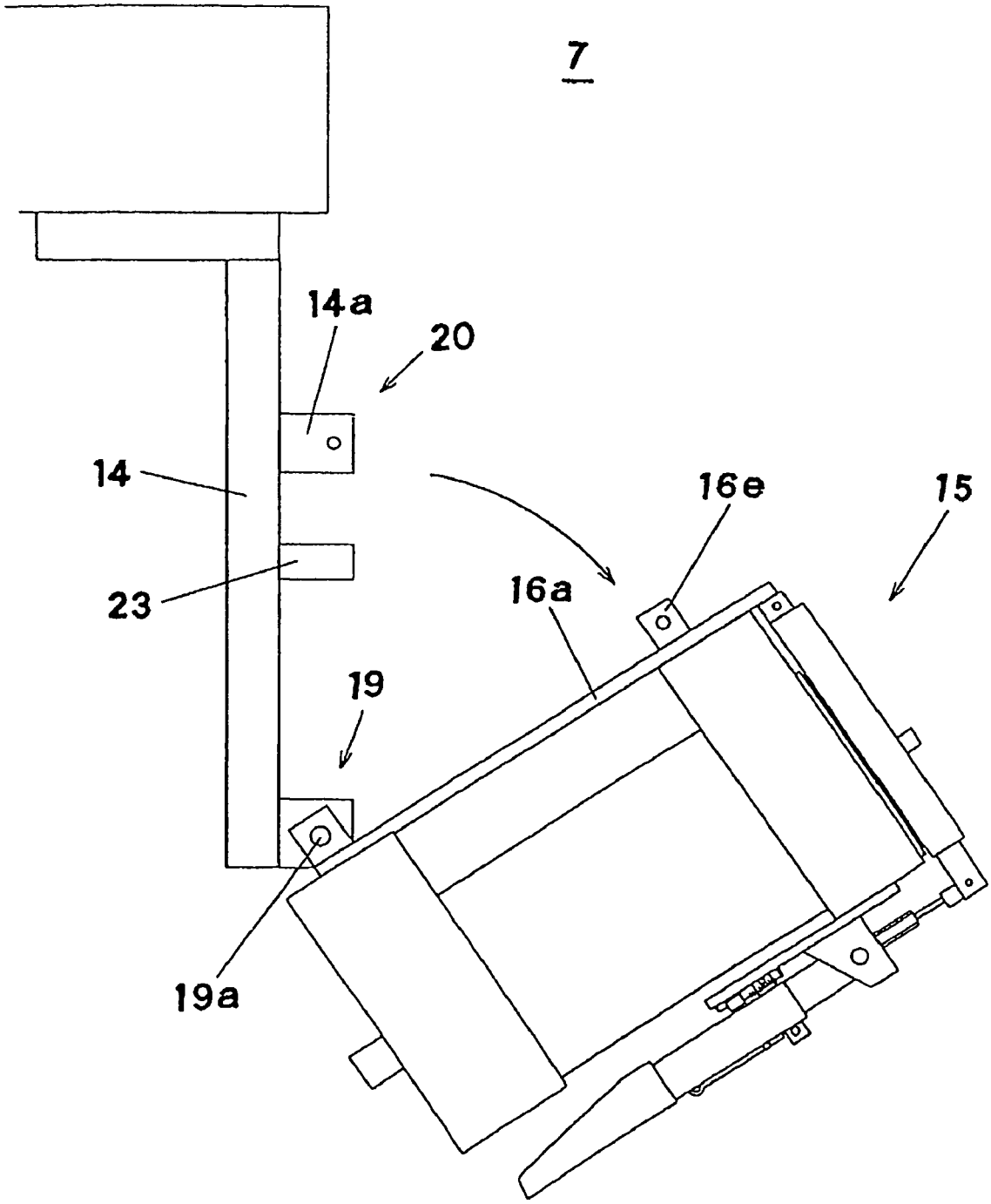
FIG. 5 is an illustration for explaining an operation of the tank head of the application apparatus in the embodiment of the invention.

In a state in which the pin 20*a* is fitted in the pin hole of the locking plate 16*e* to lock the locking plate 16*e*, the container holder 15 is supported by the hinge portion 19 and the holder fixing mechanism 20 at the upper and lower parts thereof and held by the base bracket 14 in a vertical attitude. The container holder 15 is rotated about the hinge portion 19 into a tilted attitude as shown in FIG. 5 by pulling out the grip 20*b* to the right to remove the lock of the locking plate 16*e* with the pin 20*a*.

Therefore, the hinge portion 19 coupled to the bottom part of the container holder 15 constitute a holder supporting mechanism for holding the container holder 15 in either vertical attitude or tilted attitude. The locking plate 16*e* provided on the back plate 16*a* of the holder main body 16 constitutes a locking portion which is provided at the top part of the container holder 15 and locked by the holder fixing mechanism 20.

As shown in FIG. 4, a sensor 23 for detecting the back plate 16*a* is provided on a surface of the base bracket 14 on the right side thereof. A proximity sensor or the like for magnetically or optically detecting the presence of an object is used as the sensor 23. It is detected that the container holder 15 is in a vertical attitude when the sensor 23 detects the back plate 16*a*. When the container holder 15 is in a tilted attitude as shown in FIG. 5, the sensor 23 does not detect the back plate 16*a*, and it is therefore detected that the container holder 15 is in a tilted attitude.

As shown in FIG. 3, the container 30 has a flange portion 30*b* extending outwardly from the periphery of the opening 30*a* at the top end thereof. To hold the container 30 with the holder main body 16, the container 30 is inserted from the insertion hole on the top surface of the top part 16*b*. Thus, the flange portion 30*b* abuts on the top surface of the top part 16 to be supported from underneath by the top part 16*b*. That is, the container holder 15 holds the container 30 inserted from the top side thereof in the condition where the flange portion 30*b* formed on the top end of the container is supported from underneath by the top surface of the holder main body 16.

In this condition, discharge hole 30*c* provided at the bottom end of the container 30 protrudes downward from a bottom surface of the bottom part 16*d*. The tube 8 for supplying a resin adhesive to the application head 9 is connected to the discharge hole 30*c*. A resin adhesive 31 reserved in the container 30 is discharged from the discharge hole 30*c* by a piston 32 that is pneumatically pushed down, and the adhesive is thus supplied to the application head 9 through the tube 8.

Referring to FIG. 4, the lid 19 provided above the top part 16*a* is rotatably supported by a lid hinge portion 18*a*. When the lid 18 is rotated clockwise, the lid 18 closes the opening 30*a* at the top end of the container 30 held by the holder main body 16. A portion 26 for engagement is provided on the side of the lid 18 opposite to the lid hinge portion 18*a*. A lid opening/closing mechanism 17 having a lever 27 for opening and closing the lid 18 through a link rod 25 is provided on a vertical plate 24 which is vertically secured on the top part 16*b*. The lid opening/closing mechanism 17 constitutes a lid locking mechanism for locking the lid 18 to the holder main body 16 by causing an engaging portion provided on an end of the link rod 25 to engage the portion 26 for engagement.

Figure 6:
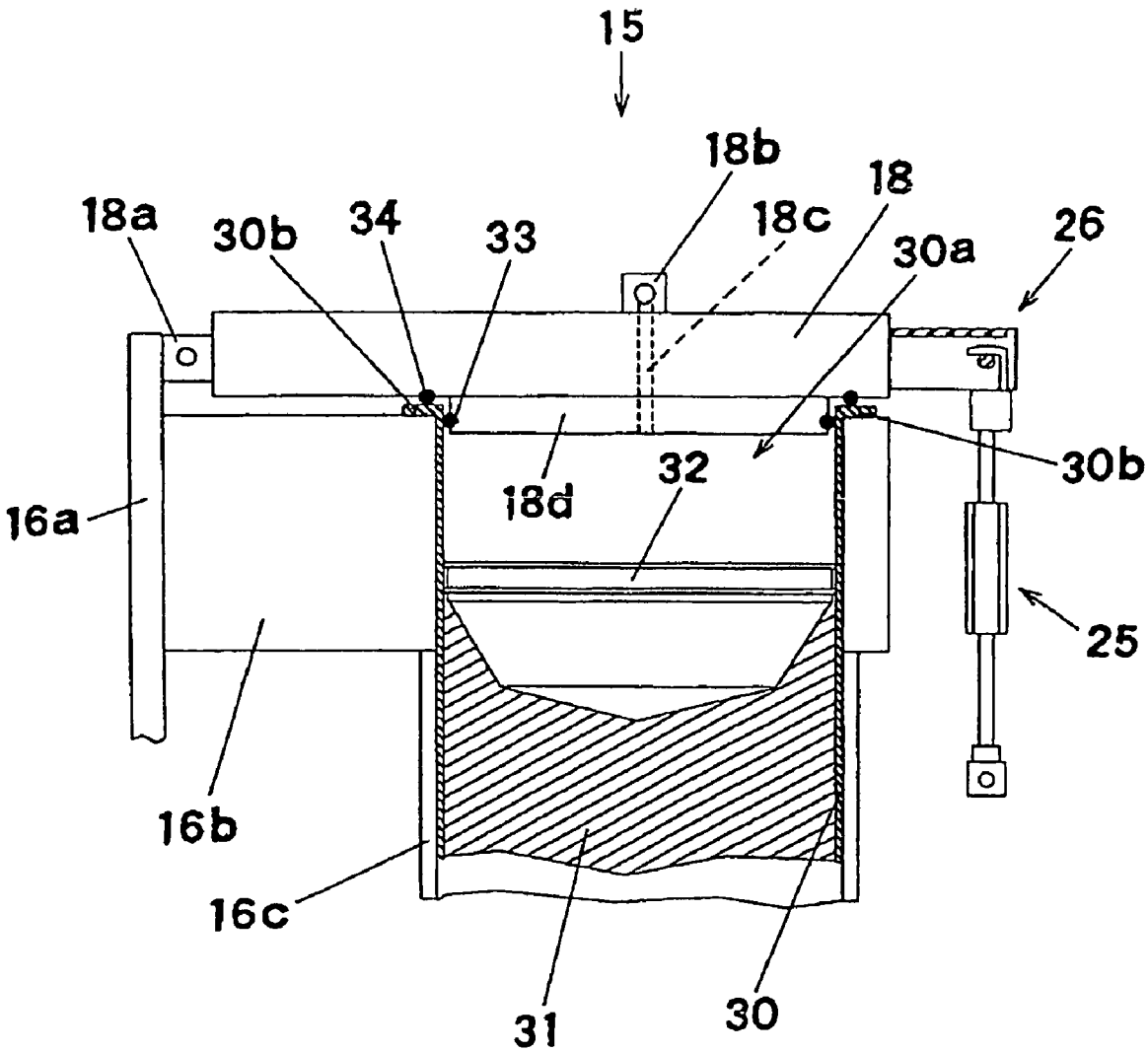
FIG. 6 is a partial sectional view of a container holder of the application apparatus in the embodiment of the invention.

FIG. 6 shows a closed state of the lid 18. A mating convex portion 18*d* having a shape adapted to the opening 30*a* of the container 30 is provided to protrude from the bottom surface of the lid 18, and a first O-ring 33 is attached to the periphery of the mating convex portion 18*d*. A second O-ring 34 is attached to the bottom surface of the lid 18 on the peripheral side the mating convex portion 18*d* in association with the position of the flange portion 30*b* in the radial direction.

The portion 26 for engagement is pulled down in engagement with the link rod 25 to fit the mating convex portion 18*d* in the opening 30*a* of the container 30 along with the O-ring 33, and the second O-ring 34 is thus put into abutment with the top surface of the flange portion 30*b* and urged against the same. As a result, the interior of the container 30 is sealed by the first O-ring 33, and the container 30 is further sealed in a peripheral position thereof by the second O-ring 34. The mating convex portion 18*d* and the first O-ring 33 constitute a first sealing portion for sealing the interior of the container 30 by being inserted into the opening 30*a* of the container 30 held by the container holder 15. The second O-ring 34 constitutes a second sealing portion for sealing the opening 30*a* by being urged in abutment with the top surface of the flange portion 30*b* supported from underneath by the top part 16*b*.

That is, the present embodiment has a configuration in which the first O-ring 33 for forming a seal by abutting on an inner circumferential surface of the opening 30*a* and the second O-ring 34 for forming a seal by abutting on the top surface of the flange portion 30*b* are provided as a sealing mechanism for sealing the container 30. It is therefore possible to provide a double seal for the container 30 to improve sealing properties. As will be described later, the setting of the first O-ring 33 and the second O-ring 34 in the sealing positions and the removal of the seals can be carried out through a single action of operating the lever 27 of the lid opening/closing mechanism 17.

A vent 18*c* for supplying a compressed gas to the interior of the container 30 thus sealed is provided on the lid 18 so as to penetrate the lid upward from a bottom surface of the mating convex portion 18*d*. The vent 18*c* is connected to an air pipe 28 (see FIG. 2) through a joint member 18*b*. A compressed gas is supplied through the vent 18*c* to the interior of the container 30 by supplying an air pressure from an air pressure supply source through the air pipe 28. As a result, the piston 32 which is mounted in the container 30 is pushed down to discharge the resin adhesive 31 reserved in the container 30 from the discharge hole 30*c*.

Figure 7:
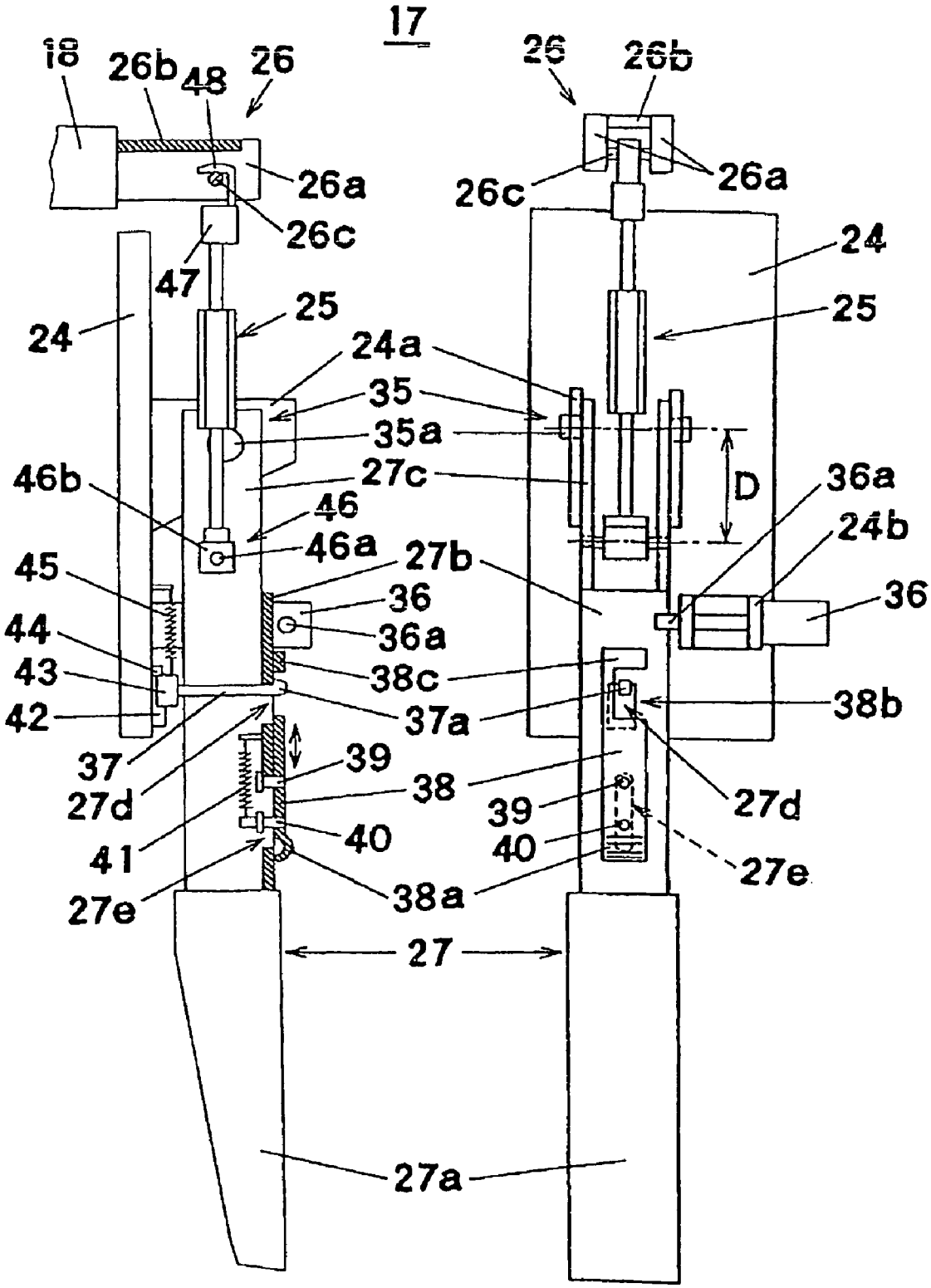
FIG. 7 is an illustration for explaining a structure of a lid locking mechanism of the container holder of the application apparatus in the embodiment of the invention.

Next, a specific structure of the lid opening/closing mechanism 17 will be described with reference to FIG. 7. Referring to FIG. 7, the lever 27 is an elongated member which is provided with a grip portion 27*a* at the bottom thereof to be gripped by an operator when operated. A lever middle portion 27*b* and a lever base portion 27*c* are provided above the grip portion 27*a*. A cylinder bracket 24*a* is provided to protrude from a front surface of the vertical plate 24 secured to the top part 16*b*, and a top end of the lever base portion 27*c* is pivoted at a first fulcrum 35 provided on the cylinder bracket 24*a* through a pin 35*a*. That is, the lever 27 is pivoted at a top end thereof by the first fulcrum 35 which is secured to the container holder 15 and is thus rotatable in the vertical direction.

Cutouts 27*d* and 27*e* are formed in two locations, i.e., upper and lower locations on the lever middle portion 27*b*, and a slide plate 8 is mounted to cover the cutouts 27*d* and 27*e*. Slide pins 39 and 40 erected on the slide plate 38 are slidably mated with a slit 27*e* formed in the lever middle part 27*b* to extend in the vertical direction, which allows the slide plate 38 to slide in the vertical direction along the lever middle portion 27*b*. The slide plate 38 is urged upward by a spring 41 coupled with the slide pin 40, and a normal position of the plate is the position in which the slide pin 39 abuts on a top end of the slit 27*e*.

A finger engaging portion 38*a* to be used for a push-down operation is provided on a bottom end of the slide plate 38, and the slide plate 38 is slid downward against the urging force of the spring 41 by pushing the finger engaging portion 38*a* downward with a finger, and the side plate 38 is returned to the normal position by removing the downward push. An extension 38*c* is provided at the top of the slide plate 38 so as to extend upward through a rectangular cutout 38*b*. As the slide plate 38 slides up and down, the extension 38*c*, which is located above the cutout 27*d* in the normal position, also slides up and down.

A guide rail 42 is disposed on the vertical plate 24 in the vertical direction in a position associated with the cutout 27*d* of the lever 27. A hook 37 is coupled with a slider 43 which is slidable mated with the guide rail 42. An upwardly bent locking end portion 37*a* is provided on an end of the hook 37 so as to protrude from the cutout 27*d*, and the locking end portion 37*a* is located in the cutout 38*b*. The slider 43 is urged upward by a spring, and an upper extreme position of the slider 43 is regulated by a stopper 44.

In a condition where the slider 43 abuts on the stopper 44 to be in the upper extreme position, the locking end portion 37*a* is located at the top end of the cutout 27*d* to lock the lever middle portion 27*b* in the horizontal direction, which prevents the lever 27 from rotating. The extension 38*c* is located above the locking end portion 37*a* protruding from the cutout 27*d* in its normal position, and the locking end portion 37*a* is pushed downward by the extension 38*c* when the slide plate 38 is slid downward. As a result, the lever middle portion 27*b* is released from the state of being locked by the locking end portion 37*a*, and the lever 27 becomes rotatable.

A lever lock cylinder 36 is disposed on the vertical plate 24 through a cylinder bracket 24*b* in an attitude in which a rod 36*a* therein lies in the horizontally direction. The lever lock cylinder 36 is driven to protrude the rod 36*a* with the lever 27 in the vertical position, whereby the rod 36*a* is located in front of the lever middle portion 27*b* to prevent the lever 27 from rotating freely. The lock provided by the lever lock cylinder 36 is removed by retracting the rod 36*a*.

As thus described, the lever 27 is reliably locked by automatic lock which can be removed only by driving the lever lock cylinder 36 in addition to the manual lock provided by the hook 37 which can be removed through a manual operation. Thus, the locked state of the lever 27 can be maintained even if the manual lock is removed by an erroneous operation at timing when the locked state of the lever 27 should not be cancelled.

A second fulcrum 46 is provided at the lever base portion 27*c* in a position which is spaced downwardly from the first fulcrum 35 by a predetermined distance D. The second fulcrum 46 has a structure in which a pivot block 46*b* coupled with a bottom end of the link rod 25 is pivoted at the lever base portion 27*c* with a pin 46*a*. Thus, the link rod 25 is pivoted at one end thereof by the second fulcrum 46 to be rotatable in the vertical direction. A coupling block 47 is coupled to a top end of the link rod 25, and a reverse L-shaped engaging hook 48 is provided on the top of the coupling block 47 so as to extend upward.

The portion 26 to be engaged provided to extend from the lid 18 in the horizontal direction has a structure in which top parts of two side plates 26*a* are connected by a cover portion 26*b* and in which a pin 26*c* to be engaged that is supported by the side plates 26*a* on both ends thereof is disposed under the cover portion 26*b*. The engaging hook 48 engages the pin 26*c* to be engaged when the lever 27 and the link rod 25 are both in an upright state, whereby the lid 18 is locked to the holder main body 16 through the link rod 25 and the lever 27 to keep the opening 30*a* in the sealed condition.

Figure 8:
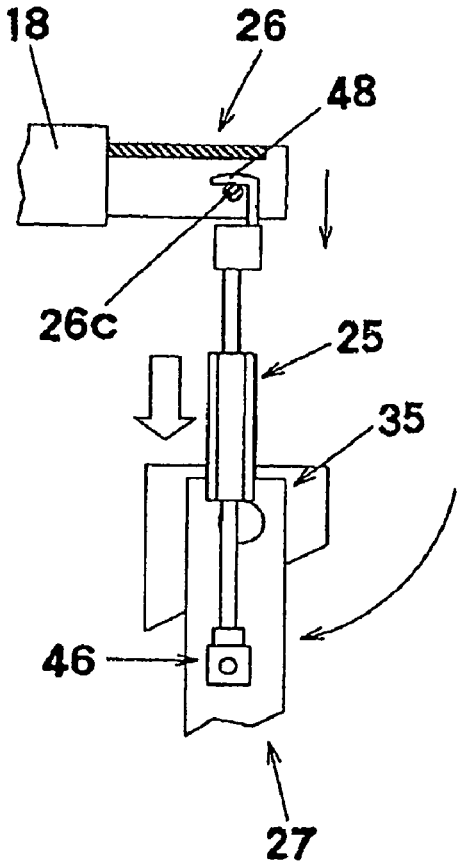
FIGS. 8(*a*) and 8(*b*) are illustration for explaining an operation of the lid locking mechanism of the application apparatus in the embodiment of the invention.
Figure 8:
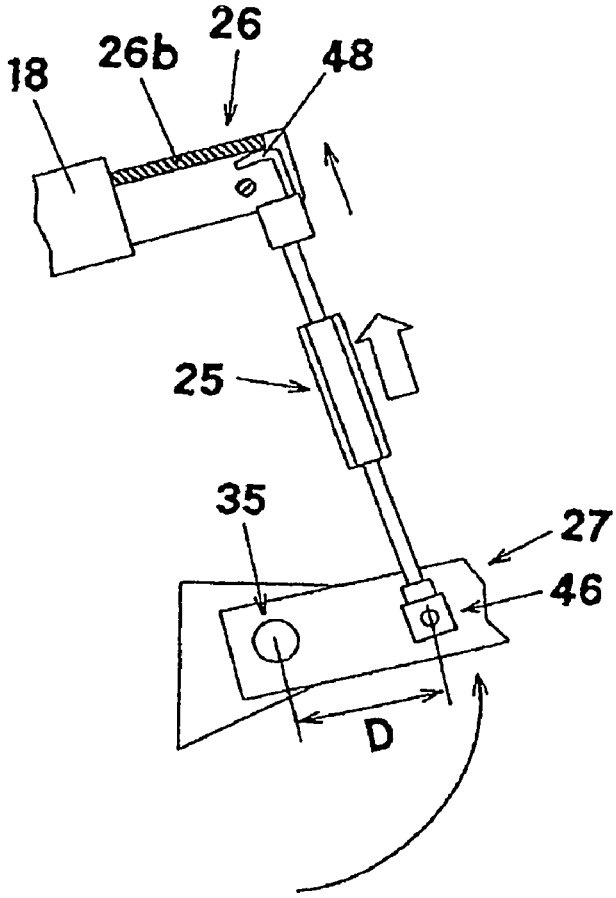

Next, a description will be made with reference to FIGS. 8(*a*) and 8(*b*) on the function of the lid opening/closing mechanism 17 which opens and closes the lid 18 when operated with the lever 27. FIG. 8(*a*) shows the operation of closing the lid 18. In this operation, the lever 27 is rotated downward (clockwise) about the first fulcrum 35 in a condition where a top surface of the pin 26*c* to be engaged is engaged with a bottom surface of the engaging hook 48. Then, the link rod 25 is pushed downward through the second fulcrum 46, and the engaged portion 26 is pulled down by the link rod 25. As a result, the lid 18 is rotated about the lid hinge portion 18*a*, and the mating convex portion 18*d* is inserted in the opening 30*a* along with the first O-ring 33, whereby the interior of the container 30 is sealed.

When the lever 27 is rotated upward in this state, as shown in FIG. 8(*b*), the link rod 25 coupled with the lever 27 is moved upward, and the engaging hook 48 leaves the top surface of the pin 26*c* to be engaged and abuts on the bottom surface of the cover portion 26*b* to push the portion 26*c* to be engaged upward. Thus, the lid 18 is rotated about the lid hinge portion 18*a* in the direction of opening the same, and the mating convex portion 18*d* inserted in the opening 30*a* of the container 30 is pulled out from the opening 30*a* along with the first O-ring 33.

That is, in the above-described configuration, the lever 27 is pivoted by the first fulcrum 35 securely provided on the container holder 15 at the top end thereof and is therefore rotatable in the vertical direction. The link rod 25 is a link member which is pivoted at one end thereof by the second fulcrum 46 provided on the lever 27 in a position spaced downward from the first fulcrum 35 by the predetermined distance D to be rotatable in the vertical direction and which has the engaging hook 48 as an engaging portion engaging the portion 26 to be engaged provided on the lid 18 at another end thereof. The engaging hook 48 and the portion 26 to be engaged are configured such that they are engaged with each other in two directions, i.e., the direction in which the first O-ring 33 is inserted in the opening 30*a* and the direction in which the first O-ring 33 is pulled out from the opening 30*a*.

The predetermined distance D is set based on the stroke over which the link rod 25 must be driven to enable the operations of opening and closing the lid 18. The link rod 25 can be driven upward and downward with a greater force by setting the leverage of the predetermined distance D to the entire length of the lever 27 appropriately to increase the operating force exerted on the grip portion 27*a* in accordance with the leverage.

The use of such a configuration allows a container 30 to be sealed with the lid 18 and to be opened with high operability even when a large-sized container 30 is used. Specifically, the use of a large container necessitates an increase in the size of an O-ring for sealing, and a greater force is consequently required for fitting and removing the O-ring in and from the opening of the container. Even in such a case, the lid 18 can be easily opened and closed with a small force by employing the mechanism for driving the link rod 25 with the lever 27 as described in the present embodiment.

Figure 9:
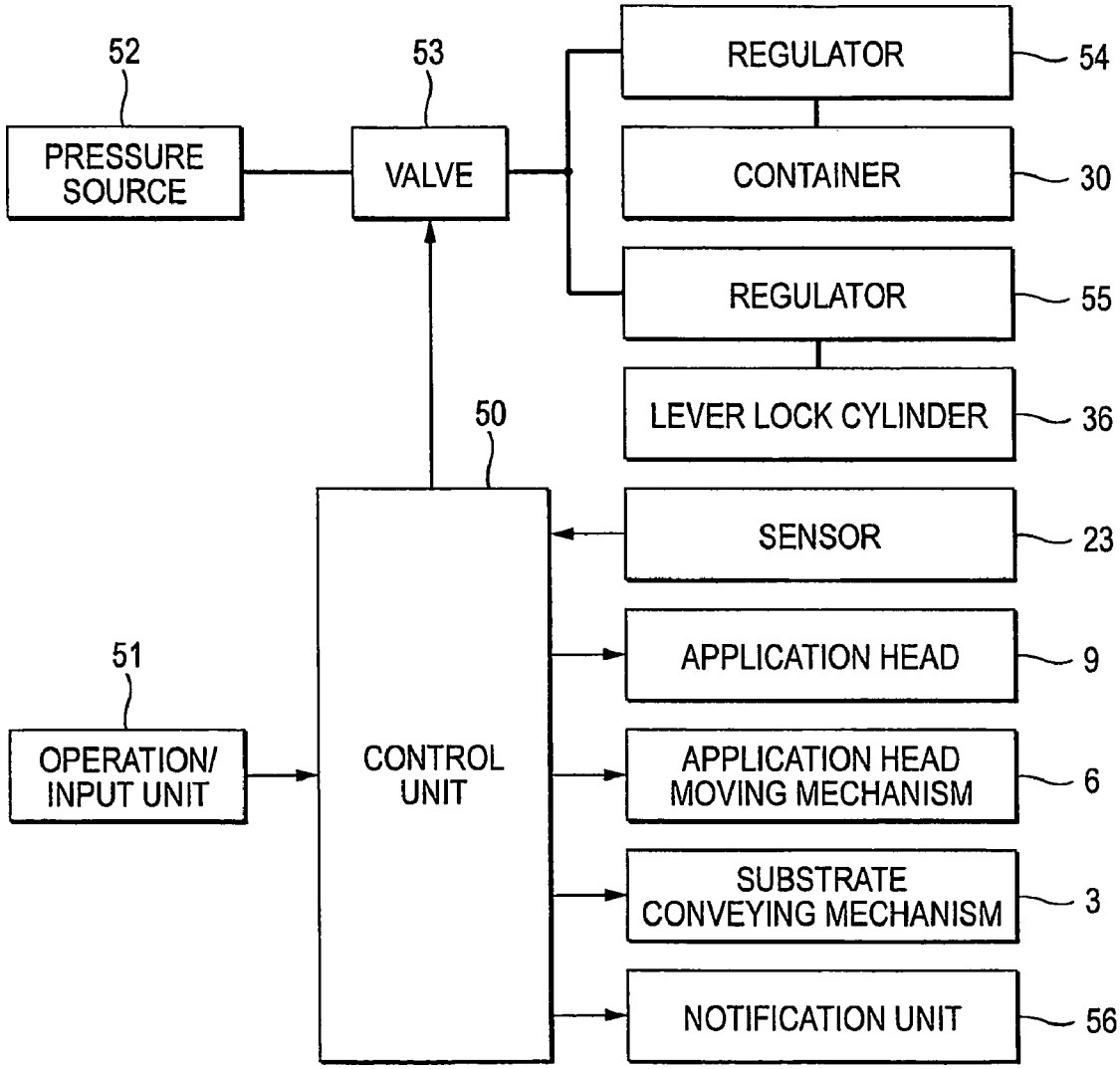
FIG. 9 is a block diagram showing a configuration of a control system of the application apparatus in the embodiment of the invention.

A configuration of a control system will now be described with reference to FIG. 9. Referring to FIG. 9, an operation/input unit 51 such as a keyboard or mouse is connected to a control unit 50, and operations of the substrate conveying mechanism 3, the application head moving mechanism 6, and the application head 9 are controlled by operation commands and data inputs from the operation/input unit 51. Based on a command from the control unit 50, a notification unit 56 provides information on predetermined items such as the attitude and condition of the container holder 15 detected by the sensor 23 using a display monitor, indication lamps, and the like. An air pressure is supplied to the container 30 and the lever lock cylinder 36 through regulators 54 and 55, respectively. A valve 53 is interposed in an air pressure supply path from a pressure source 52 to the regulators 54 and 55, and the supply of an air pressure to the container 30 and the lever lock cylinder 36 is controlled through control over the valve 53 exercised by the control unit 50.

Figure 10:
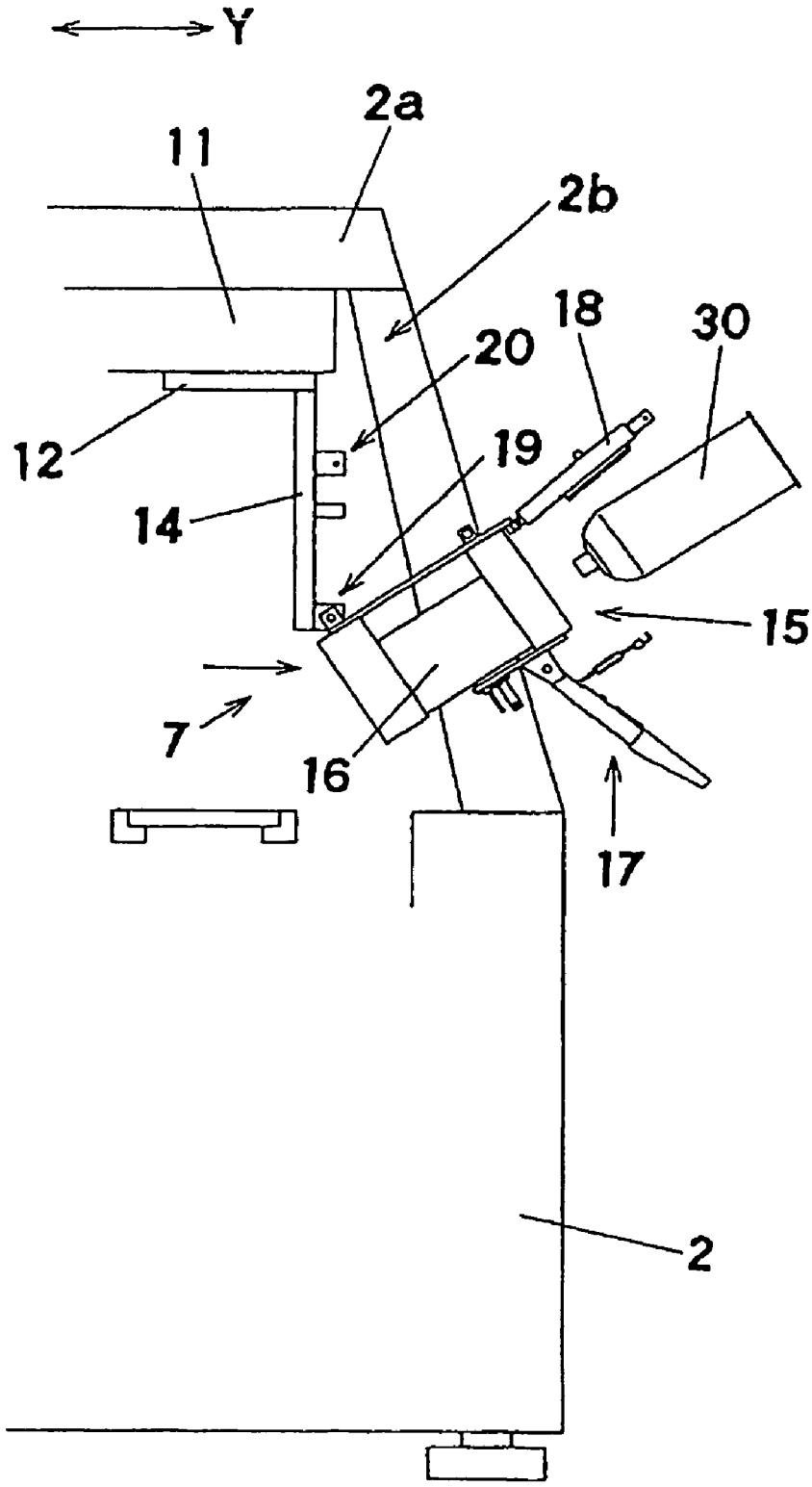
FIG. 10 is an illustration for explaining a container replacing operation at the application apparatus in the embodiment of the invention.

A description will now be made with reference to FIG. 10 on an operation of moving the container holder 15 to replace the container 30. When the resin adhesive 31 in the container 30 is used up in the process of continuing the operation of discharging the resin adhesive 31 from the container 30 to supply it to the application head 9, a container replacing operation is carried out. At the container replacing operation, as shown in FIG. 10, the Y-axis table 11 is first driven to move the Y-direction moving member 12 in the Y-direction.

Thus, the container holder 15 is moved, along with the holder fixing mechanism 20 and the Y-direction moving member 12 to which the hinge portion 19 is attached through the base bracket 14, to a replacing position near the cover opening 3*b* where the apparatus can be worked on from the outside. Then, the holder fixing mechanism 20 is disengaged to allow the container holder 15 to rotate about the hinge portion 19, and the container 15 is thereby put in a tilted attitude as shown in FIG. 10. Next, the lid opening/closing mechanism 17 is then disengaged to release the lid 18 from the holder main body 16, and an operation of taking out the used container 30 from the holder main body 16 to replace it with a new container 30 is performed.

In the above-described configuration, the Y-direction moving member 12 is a horizontally moving member which is moved in the horizontal direction with the holder fixing mechanism 20 and the hinge portion 19 attached thereto. The Y-axis table 11 is horizontal moving means which moves the Y-direction moving member 12 in a predetermined work area when the liquid substance is to be supplied and which moves the Y-direction moving member to the predetermined replacing position when the container 30 is to be replaced.

The container 30 can be attached and removed to and from the container holder 15 with high operability by employing the configuration in which the container holder 15 is moved to a replacing position and tilted there as thus described. In addition, there is no need for reserving a space for attaching and removing the container 30 to and from the container holder 15 in the apparatus unlike apparatus according to the related art in which a container is attached and removed inside the apparatus. Therefore, there is an advantage in that the size of an apparatus is reduced even when the apparatus accommodates a large container having a great height dimension.

Figure 11:
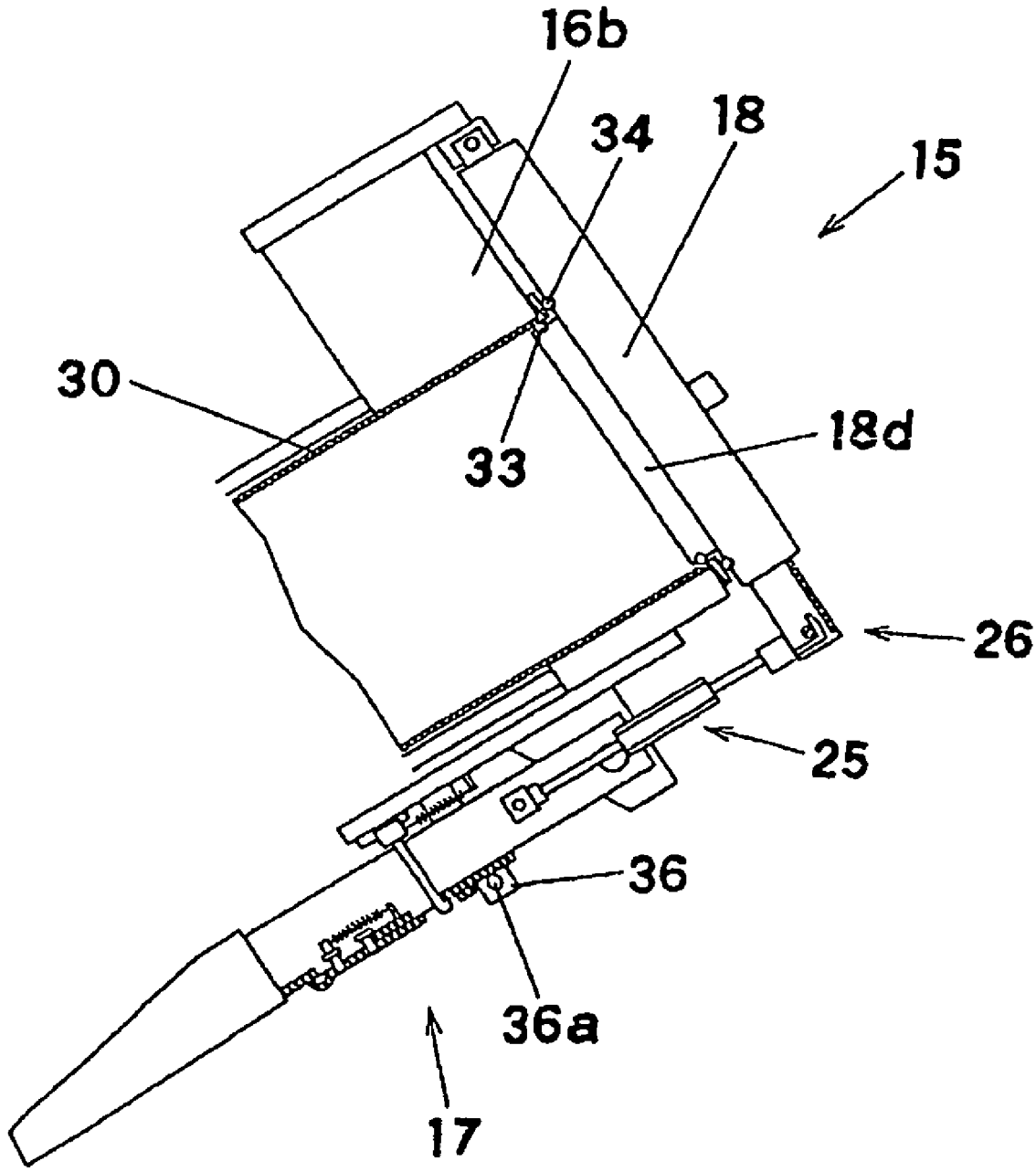
FIG. 11 is an illustration for explaining a lid opening/closing operation at a container holder of the application apparatus in the embodiment of the invention.

Details of an operation of opening the lid 18 during the above-described container replacing operation will now be described with reference to FIGS. 11 to 15. FIG. 11 shows a state in which the container holder 15 is tilted by disengaging the holder fixing mechanism 20 after pulling out the tank head 7 to the replacing position. Specifically, in this state, the container 30 is supported from underneath by the top part 16*b* at the flange portion 30*b*; the mating convex portion 18*d* is inserted in the opening 30*a* of the container 30 along with the first O-ring 33; and the second O-ring 34 is urged against the flange portion 30*b*. The lid 18 is locked by the lid opening/closing mechanism 17.

Figure 12:
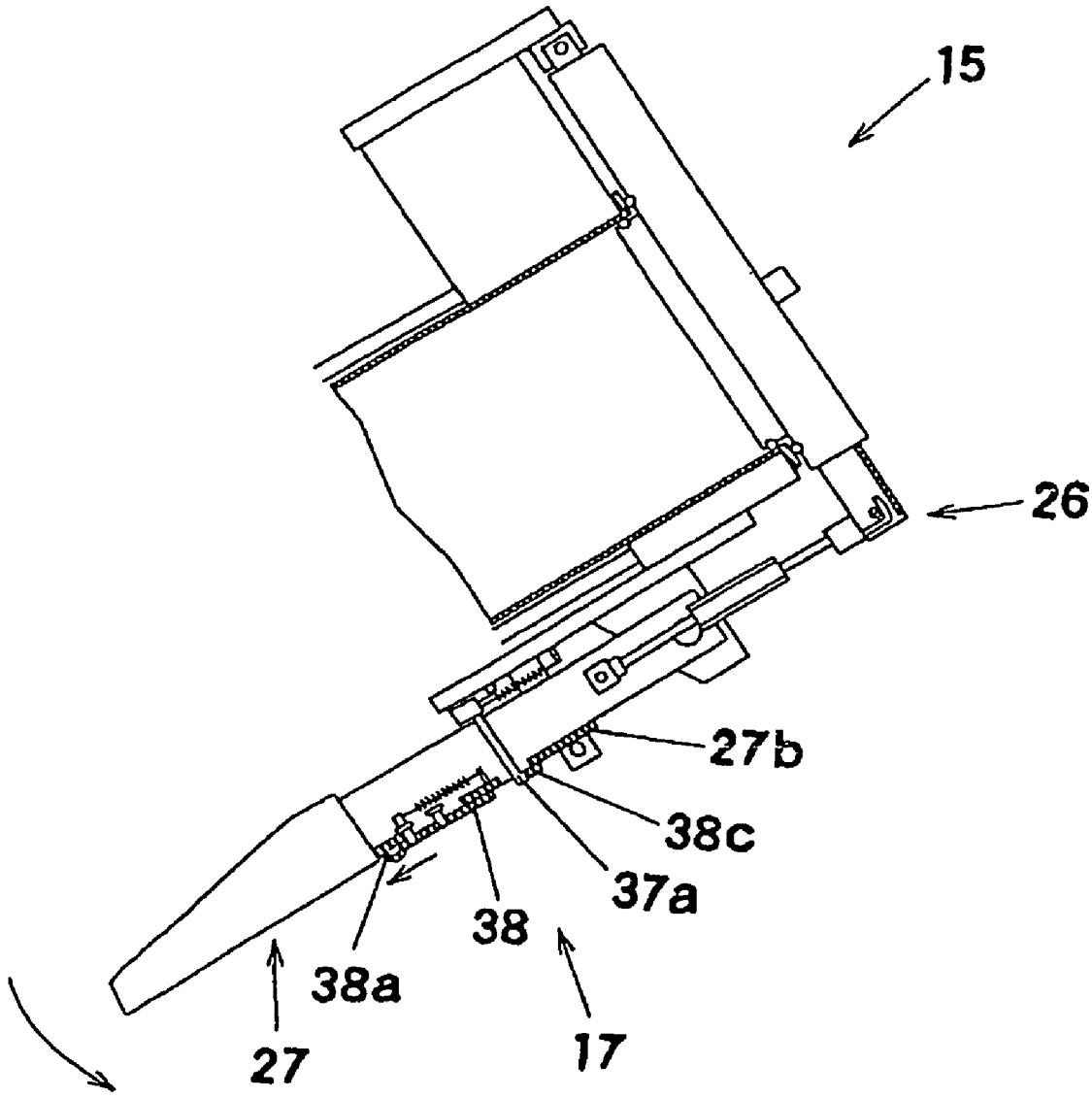
FIG. 12 is an illustration for explaining the lid opening/closing operation at the container holder of the application apparatus in the embodiment of the invention.
Figure 13:
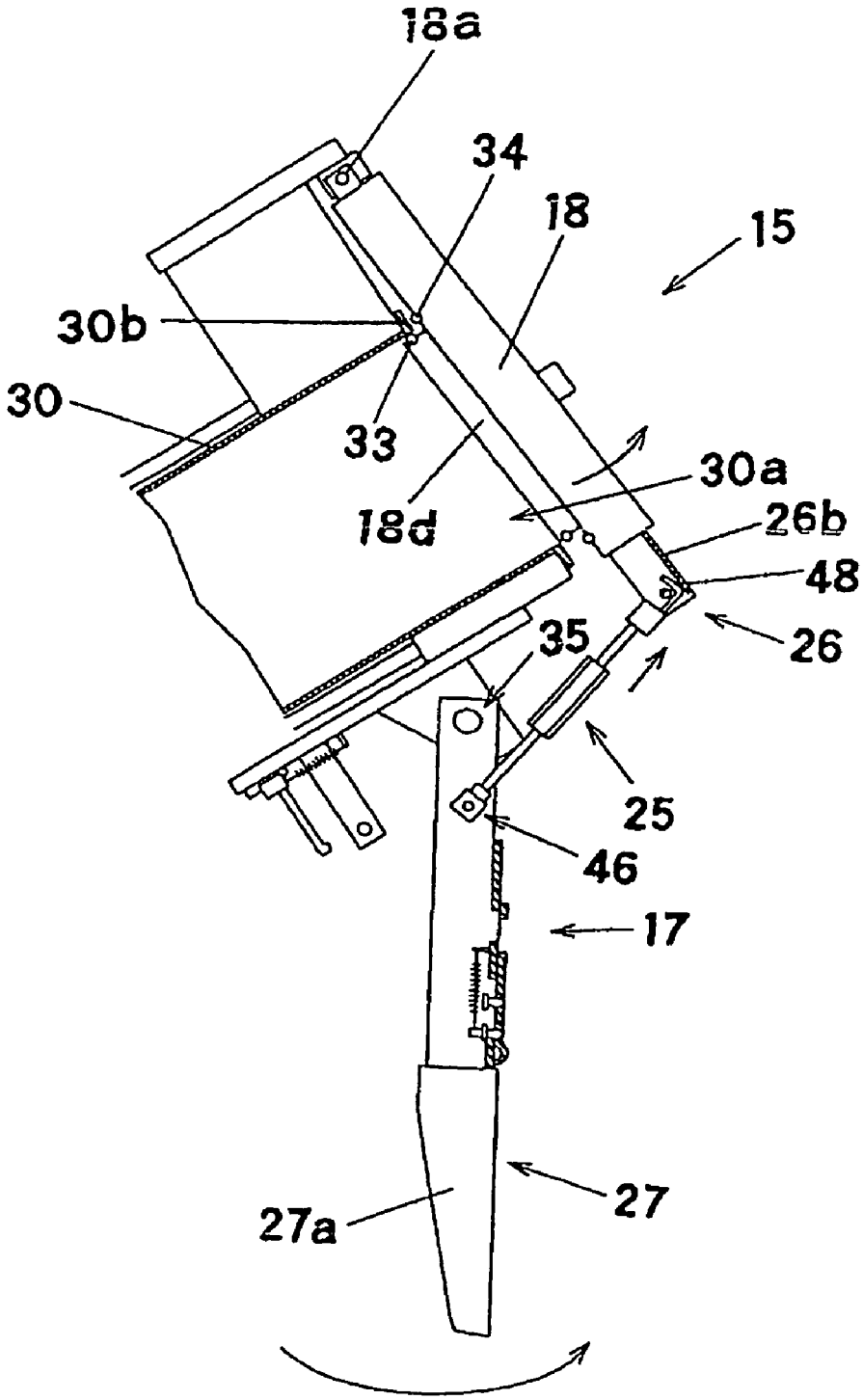
FIG. 13 is an illustration for explaining the lid opening/closing operation at the container holder of the application apparatus in the embodiment of the invention.

To open the lid 18, the operation/input unit 51 is first operated to remove the lever lock provided by the lever lock cylinder 36. Specifically, the lever lock cylinder 36 is driven to retract the rod 36*a* toward the other side of the plane of the drawing. Next, the grip portion 27*a* of the lever 27 is gripped and pushed down with the finger engaging portion 38*a* engaged with a finger to perform an operation of sliding the slide plate 38 downward as shown in FIG. 12. Thus, the locking end portion 37*a* is pushed downward by the extension 38*c* to leave the position for locking the lever middle portion 27*b*, whereby the lever 27 is released from the lock provided by the hook 37.

Thereafter, the lid 18 is opened. Specifically, the grip portion 27*a* is gripped and pulled toward this side (to the right in the figure) to rotate the lever 27 upward. Thus, the lever 27 rotates about the first fulcrum 35, and a movement of the second fulcrum 46 resulting from the rotation causes an upward movement of the link rod 25. As a result of the upward movement of the link rod 25, the engaging hook 48 abuts on the cover portion 26*b* to push it upward. Thus, the mating convex portion 28*d* is pulled out from the opening 30*a* of the container 30 along with the first O-ring 33, and the second O-ring 34 is released from the urge against the flange portion 30*b*.

Figure 14:
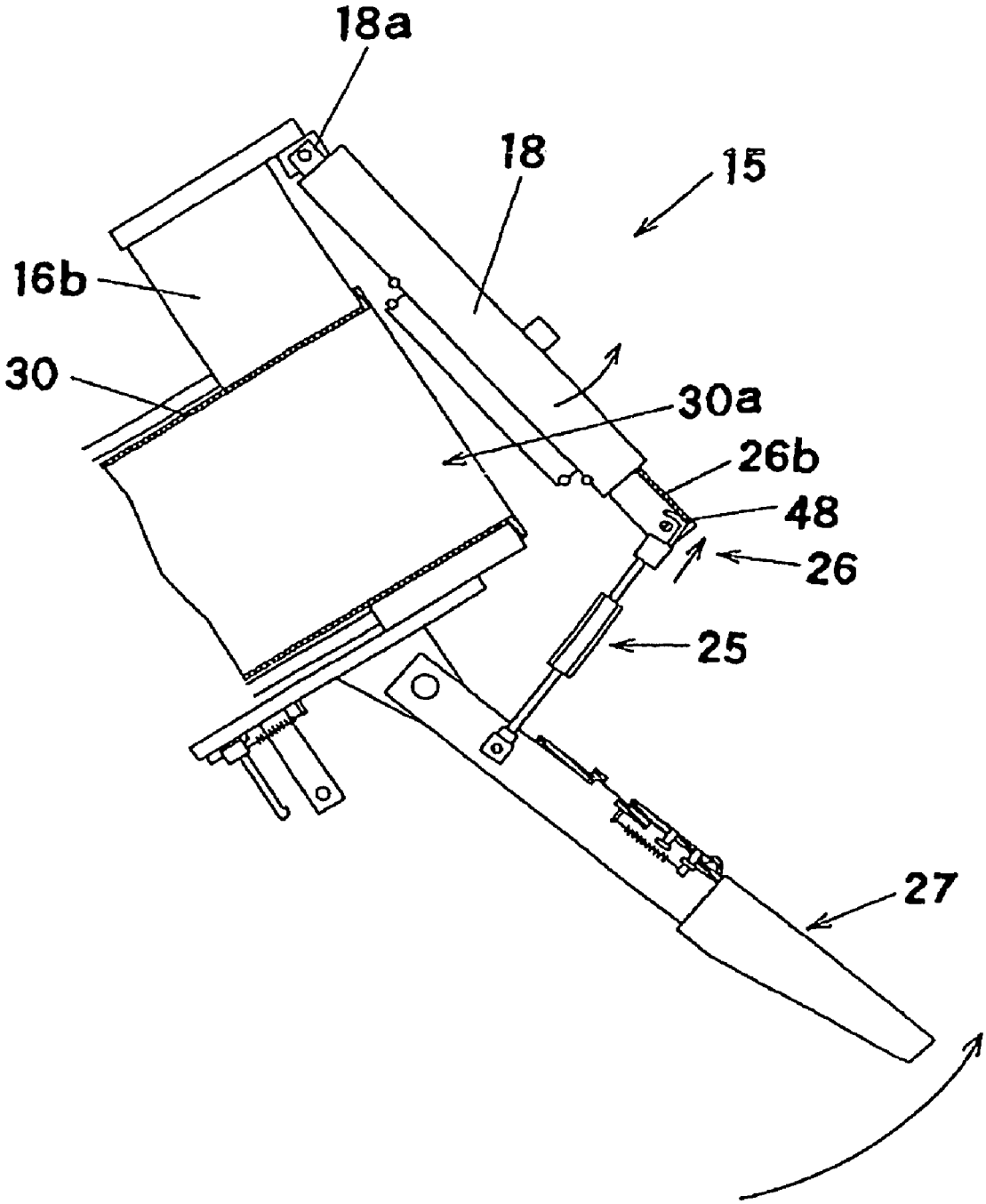
FIG. 14 is an illustration for explaining the lid opening/closing operation at the container holder of the application apparatus in the embodiment of the invention.
Figure 15:
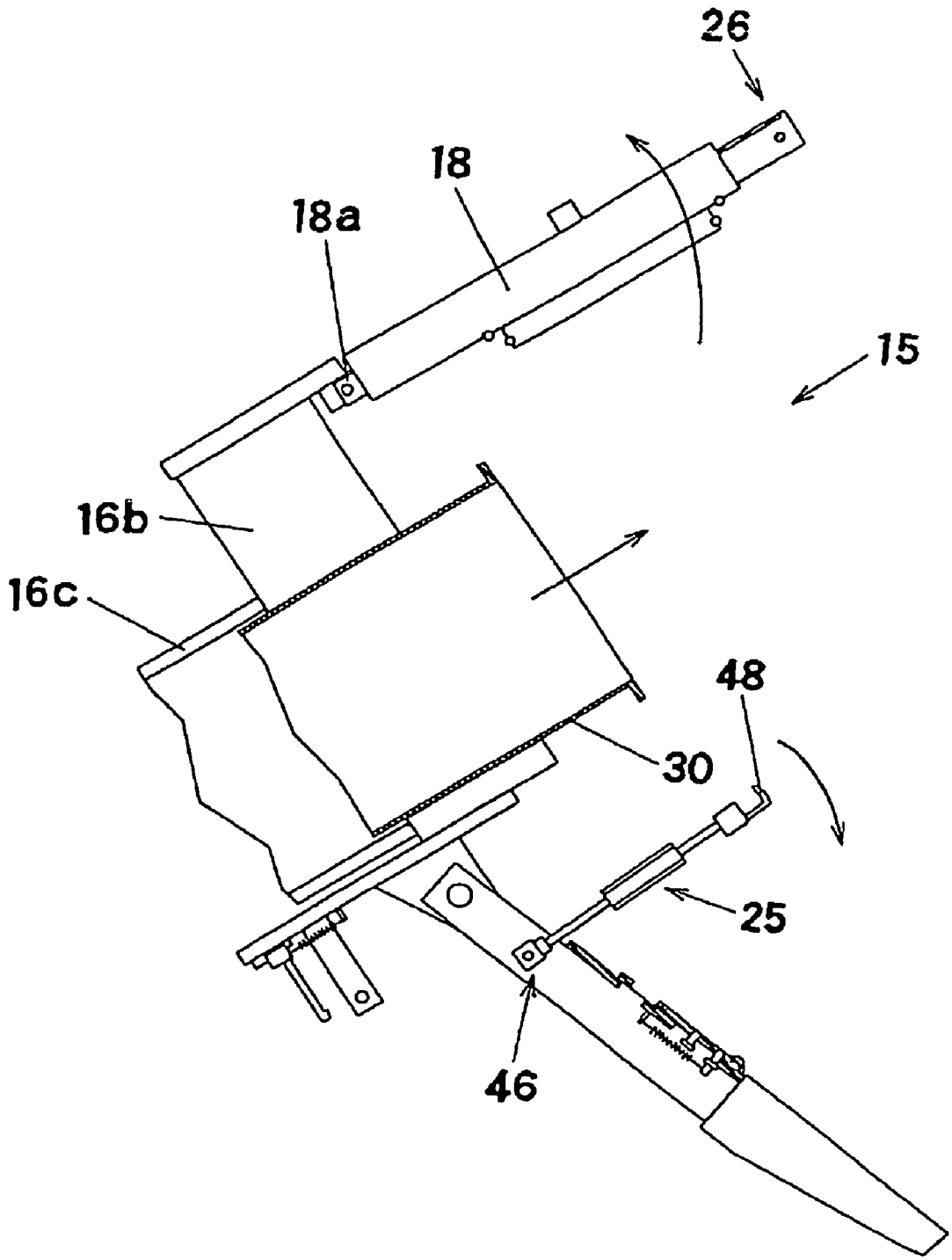
FIG. 15 is an illustration for explaining the lid opening/closing operation at the container holder of the application apparatus in the embodiment of the invention.
Figure 16:
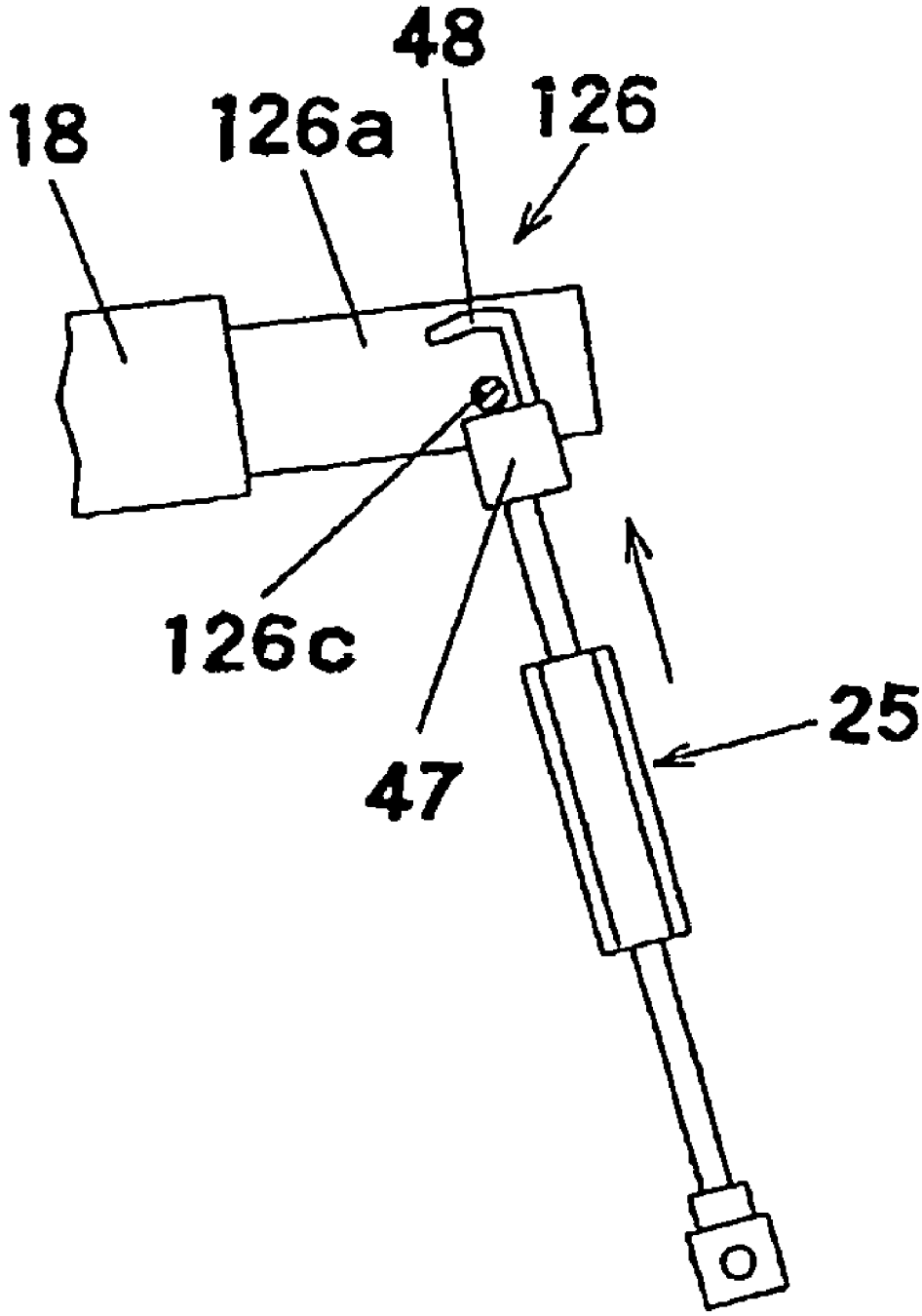
FIG. 16 is an illustration for explaining an operation of the lid locking mechanism of the container holder of the application apparatus in the embodiment of the invention.

When the lever 27 is further rotated upward thereafter, the lid 18 moves in the direction in which it is further spaced from the top part 16*b* as shown in FIG. 14. When the engaging hook 48 is elevated to a position where it can be released from the engagement with the engaged portion 26, the link rod 25 is rotated about the second fulcrum 46 as shown in FIG. 15 to remove the engagement between the engaging hook 48 and the engaged portion 26. Thus, the lid 18 is put in a condition in which it can freely rotate about the lid hinge portion 18*a*. Then, the lid 18 is rotated upward until the lid 18 is substantially at right angles to the top part 16*b*, and the container 30 is attached or removed to or from the container 30 in this state. In the above-described embodiment, the portion to be engaged provided on the lid 18 is exemplified by the portion 26 to be engaged having a configuration including the cover portion 26*b* on which the engaging hook 48 provided on the link rod 25 abuts from underneath. A portion 126 to be engaged having a configuration as shown in FIG. 16 may alternatively be used. In this example, a configuration is employed, in which a pin 126*c* to be engaged similar to the pin 26*c* to be engaged is provided on side plates 126*a* having a shape similar to that of the side plates 26*a*.

When the portion 126 to be engaged is pushed upward by the link rod 25, the top surface of the coupling block 47 abuts on a bottom surface of the pin 126*c* to be engaged, which allows the push-up operation to be performed in a way similar to that shown in FIG. 8(*b*). That is, in this example, the coupling block 47 along with the engaging hook 48 serves as an engaging portion to engage the portion 126 to be engaged.

As described above, the liquid substance supplying device shown in the present embodiment has a configuration including a container holder supporting mechanism for holding a container inserted through an insertion hole provide on a top side in either upright attitude or tilted attitude and a container holder fixing mechanism for fixing the attitude of a container holder in the upright state, as a structure for holding a container holder at a tank head. Thus, a container can be easily mounted and removed to and from a container holder to improve operability even when a large-capacity container having a great height dimension is accommodated.

As the mechanism for opening and closing the lid to seal a container, a configuration is employed, in which a lever is rotated downward to seal the interior of the container in a condition where an engaging portion provided on a lever for opening and closing the lid is engaged with a portion to be engaged provided on the lid for sealing the container and in which the lid is opened by rotating the lever upward to push the engaged portion upward with the engaging portion. As a result, it is possible to provide a liquid substance supplying device which exhibits high sealing performance and high operability in lid opening and closing operations when it accommodates a large-capacity container necessitating a greater force than in the related art at the time of lid opening and closing operations.

This application is based upon and claims the benefit of priorities of Japanese Patent Application Nos. 2005-170649 and 2005-170650 both filed on Jun. 10, 2005, the contents of which are incorporated herein by reference in its entirety.

INDUSTRIAL APPLICABILITY

The liquid substance supplying device according to the invention is characterized in that it exhibits high sealing performance and operability when it accommodates a container having a large capacity, and is advantageous for applications in which a liquid substance such as a resin adhesive is supplied by discharging it from a container.

The invention claimed is:

1. A liquid substance supplying device for supplying a liquid substance reserved in a vertically elongated container, comprising:

a container holder for holding said container inserted through an insertion hole provided on a top side thereof, wherein said container holder includes:

a holder main body which is provided with said insertion hole and which holds said container inserted therein;

a lid for closing an opening at a top end of said container held by said holder main body; and a lid locking mechanism for locking said lid to said holder main body with the lid in a closed state;

a holder supporting mechanism for supporting said container holder in either upright attitude or tilted attitude; and a holder fixing mechanism for fixing the attitude of said container holder in the upright state thereof, wherein said lid locking mechanism comprises:

a lever which is pivoted by a first fulcrum secured to said container holder at a top end thereof to be rotatable in the vertical direction; and a link member which is pivoted by a second fulcrum provided on said lever in a position apart from said first fulcrum at one end thereof to be rotatable in the vertical direction and which has an engaging portion engaging a portion to be engaged provided on said lid at another end thereof; and said sealing portion is inserted in said opening to seal the interior of said container by rotating said lever downward with said engaging portion engaged with said portion to be engaged and such that said sealing portion inserted in said opening is pulled out by rotating said lever upward to push said engaged portion upward with said engaging portion.

2. A liquid substance supplying device according to claim 1 further comprising a vent for supplying a compressed gas to the interior of said container that is sealed.

3. A liquid substance supplying device according to claim 1, wherein said engaging portion and said portion to be engaged are engaged with each other in two directions, i.e., the direction in which said sealing portion is inserted into said opening and the direction in which the sealing portion is pulled out from said opening.

4. A liquid substance supplying device for supplying a liquid substance reserved in a substantially cylindrical container having an opening at a top end thereof, comprising:

a container holder for holding said container inserted from a top side thereof with a flange portion formed on said top end supported from underneath by a top surface of a holder main body;

a holder supporting mechanism for supporting said container holder in either upright attitude or tilted attitude;

a holder fixing mechanism for fixing the attitude of said container holder in the upright state;

a lid having a first sealing portion which is inserted in the opening of said container held by said container holder to seal the interior of said container and a second sealing portion which abuts on a top surface of said flange portion supported from underneath by said holder main body and is urged by the surface to seal said opening;

a lever which is pivoted by a first fulcrum secured to said container holder at a top end thereof to be rotatable in the vertical direction; and a link member which is pivoted by a second fulcrum provided in a position of said lever apart from said first fulcrum at one end thereof to be rotatable in the vertical direction and which has an engaging portion engaging a portion to be engaged provided on said lid at another end thereof; and said lever is rotated downward with said engaging portion engaged with said portion to be engaged to insert said first sealing portion into said opening and to urge said second sealing portion against the top surface of said flange portion.

5. A liquid substance supplying device according to claim 4, wherein the first sealing portion inserted in said opening is pulled out by rotating said lever upward to push said engaged portion upward with said engaging portion.

6. A liquid substance supplying device according to claim 4, further comprising a vent for supplying a compressed gas to the interior of said container sealed by said first sealing portion.

7. A liquid substance supplying device according to claim 4, wherein said engaging portion and said portion to be engaged are engaged with each other in two directions, one being a direction in which said first sealing portion is inserted into said opening and other being a direction in which said first sealing portion is pulled out from said opening.

* * * * *